United States Patent [19]

Perkins

[11] 4,153,968

[45] May 15, 1979

[54] CLEANING DEVICE

[76] Inventor: Larry M. Perkins, 505 Summer St., Burlington, Iowa 52601

[21] Appl. No.: 822,787

[22] Filed: Aug. 8, 1977

[51] Int. Cl.[2] ..... A47L 5/00

[52] U.S. Cl. ..... 15/321

[58] Field of Search ..... 15/320, 321, 322

[56] References Cited

U.S. PATENT DOCUMENTS

| | | | |
|---|---|---|---|
| 2,757,406 | 8/1956 | Decker | 15/321 |
| 3,431,582 | 3/1969 | Grave | 15/321 |
| 3,538,535 | 11/1970 | Ginsburgh et al. | 15/322 X |
| 3,614,797 | 10/1971 | Jones | 15/321 X |
| 3,747,155 | 7/1973 | Koellisch | 15/321 X |
| 3,774,260 | 11/1973 | Emus | 15/353 X |
| 3,774,261 | 11/1973 | Colt | 15/321 |
| 3,812,552 | 5/1974 | Blackmon | 15/321 |
| 3,821,830 | 7/1974 | Sundheim | 15/321 |

*Primary Examiner*—Christopher K. Moore
*Attorney, Agent, or Firm*—Thomas E. Frantz

[57] ABSTRACT

A cleaning device including a generating unit, a remote cleaning head having a dispensing chamber through which a heated cleaning solution is applied to a surface to be cleaned, and a closed circuitous system connected to a source of an aqueous liquid, a source of detergent, and the dispensing chamber of the remote head. As the cleaning device is used, liquid and detergent simultaneously enter the circuitous system and are mixed and circulated therein while simultaneously being heated to and maintained at a preselected temperature of about 180° F. to provide a continuing supply of heating cleaning solution at the cleaning head.

During use of the device, a suction blower creates a vacuum which extends from a tank within the generating unit through a flexible hose and into a suction chamber in the cleaning head. Thus, spent cleaning solution and entrained soil and debris will be drawn from the surface and into the tank. This tank is automatically evacuated through a drain conduit when the quantity of spent solution therein reaches a predetermined level.

5 Claims, 5 Drawing Figures

10
12
14
16
18
20
22
24
54
56
68
70
72
74
76
78
80
82
84
86
88
90
92
94
96
98
100
102
104
106
108
114
118
126
130
134
150
172
204
206

CLEANING DEVICE

BACKGROUND OF THE INVENTION

1. Field of the Invention

The present invention relates generally to cleaning apparatus and more particularly to a cleaning device adapted for cleaning in situ carpeting, upholstery and similar materials of the type used in the interior of automobiles, trucks, buses, campers, boats, aircraft and other like vehicles.

2. Description of the Prior Art

The prior art is replete with proposals for cleaning devices of the type having a head with a first chamber through which a heated cleaning solution is directed onto a surface to be cleaned, and a second chamber through which spent cleaning solution and entrained soil are removed by vacuum or suction. U.S. Pat. Nos. 3,747,155, 3,663,984, Re. 26,950 (originally 3,262,146), 3,774,261, 3,355,762, 3,402,420, 2,960,710, 2,531,370, 1,929,345, and Re. 27,792 are representative of several such prior devices. All of these prior devices have presented various problems and drawbacks, however, such as an inability to provide continuous operation and/or to maintain a supply of heated cleaning solution at the cleaning head for immediate application after periods of non-use. Some of these problems may have been recognized in U.S. Pat. Nos. 3,496,592 and 3,828,390, as the devices illustrated therein appear to be adapted for substantially continuous operation. However, neither device is capable of maintaining a supply of heated cleaning solution at the cleaning head during periods of non-use. Thus, after such periods, the cleaning heads and supply lines of these prior devices would have to be "purged" or drained of cold solution before being placed back into use. Such purging obviously would be inconvenient, time consuming and wasteful.

SUMMARY OF THE INVENTION

It is a principal object of this invention to provide an improved cleaning device.

Another object of this invention is the provision of a cleaning device which not only is capable of continuous operation but which automatically maintains a supply of heated cleaning solution at the cleaning head at all times ready for immediate application.

A still further object of this invention is to provide a cleaning device having a circuitous circulating system into which an aqueous liquid and a detergent are automatically injected to form a continuing supply of cleaning solution which is heated to and maintained at a predetermined temperature of about 180° F. as cleaning of a surface progresses.

Yet another object of this invention is the provision of a cleaning device having means for automatically disposing of spent cleaning solution and entrained soil without interference with the operation of the device.

A still further object of this invention is to provide a cleaning device which can be conveniently and quickly releasably coupled to an aqueous supply source and drain.

Yet another object of this invention is the provision of a cleaning device capable of continuously forming an aqueous cleaning solution in a system which heats the solution to a preselected temperature and circulates the solution in a continuous stream through a remote cleaning head while maintaining the solution at the preselected temperature for immediate application to a surface to be cleaned.

These and other objects of the present invention will become apparent from the following description and accompanying drawings.

In essence, this invention contemplates the provision of a cleaning device including a generating unit, a remote cleaning head of the type having a valve controlled dispensing chamber, and flexible supply lines between the unit and head. The unit, head and supply lines cooperatively form a circuitous passage or system adapted to receive a continuous supply of liquid and detergent, mix the liquid and detergent to form a cleaning solution, heat the solution to a preselected temperature of about 180° F., and circulate the heated solution continuously through the cleaning head while maintaining the solution at the preselected temperature whereby heated cleaning solution is always immediately available even after periods of non-use of the device.

DESCRIPTION OF THE PREFERRED EMBODIMENT

Figures 1, 2:
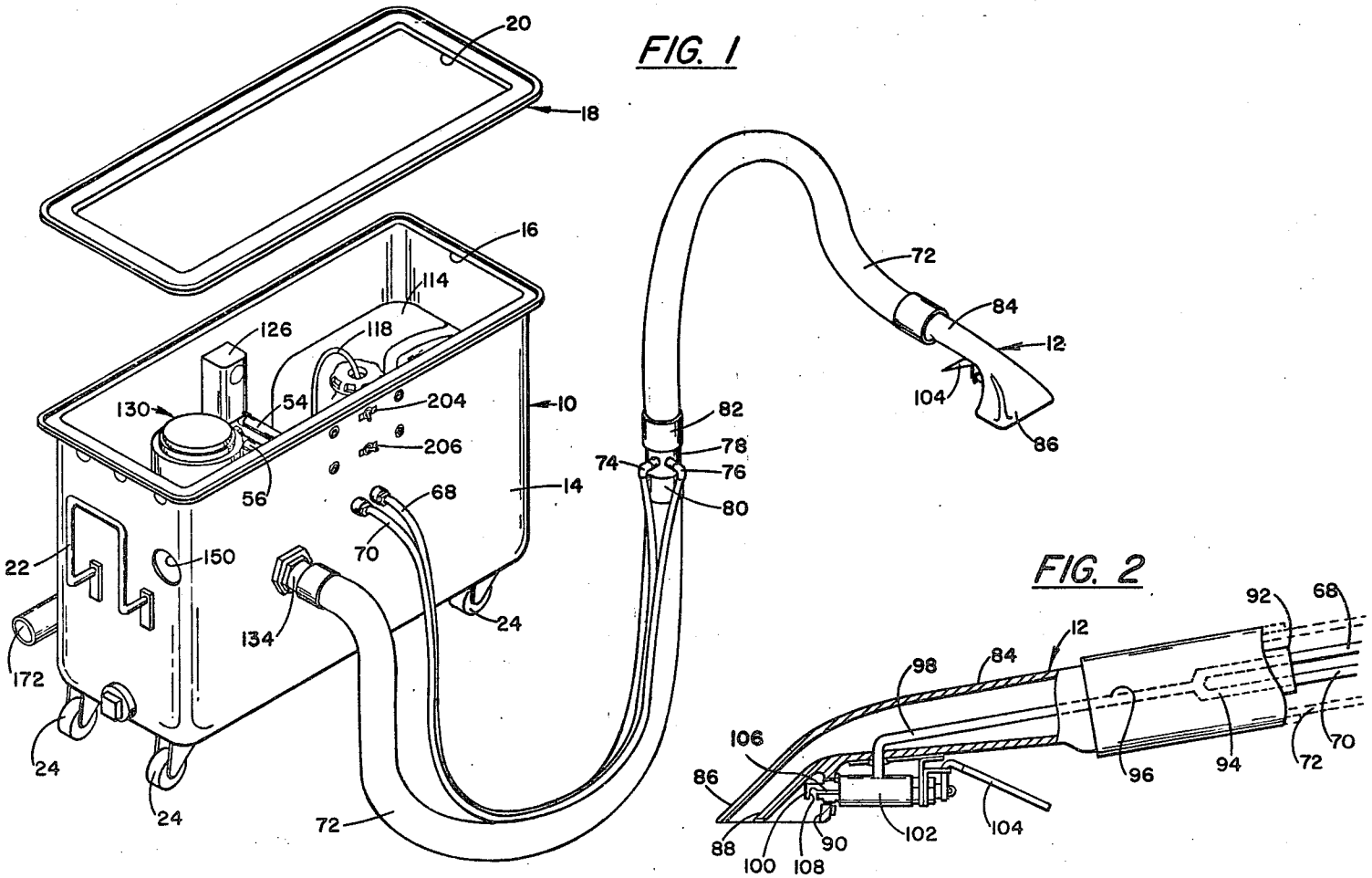
FIG. 1 is a perspective view of a cleaning device constructed in accordance with a preferred embodiment of this invention.
FIG. 2 is a side view, partially in section, showing the cleaning head of the embodiment of FIG. 1.

Referring now to the drawings and particularly to FIG. 1 thereof, it will be noted that the preferred embodiment of this invention consists of a cleaning device having a generating unit 10, a remote cleaning head 12 and various connective hoses.

The operating components of the generating unit are contained within a generally rectangular parallelepiped housing 14 having a top opening 16 which normally is closed by a removable cover 18. It will be seen that cover 18 includes a rectangular offset 20 sized to fit within top opening 16 for purposes of holding the cover in proper position.

Although housing 14 may be made of any one of a number of materials such as steel or aluminum sheet, preferably it will be formed of a fiberglass reinforced synthetic resin. Such a material has been found to be particularly suitable because of its relative light weight, corrosion and impact resistance, and ability to provide and maintain a smooth, glossy and chip resistant finish.

A handle 22 is provided at each end of the housing 14 not only to permit convenient movement of the generating unit 10, but to provide support for the connective hoses should they be wrapped around the housing 14, as during movement or storage of the device. Also, a plurality of wheels or casters 24 may be mounted on the bottom of the housing 14 as a further convenience in shifting or moving the generating unit 10.

Figure 3:
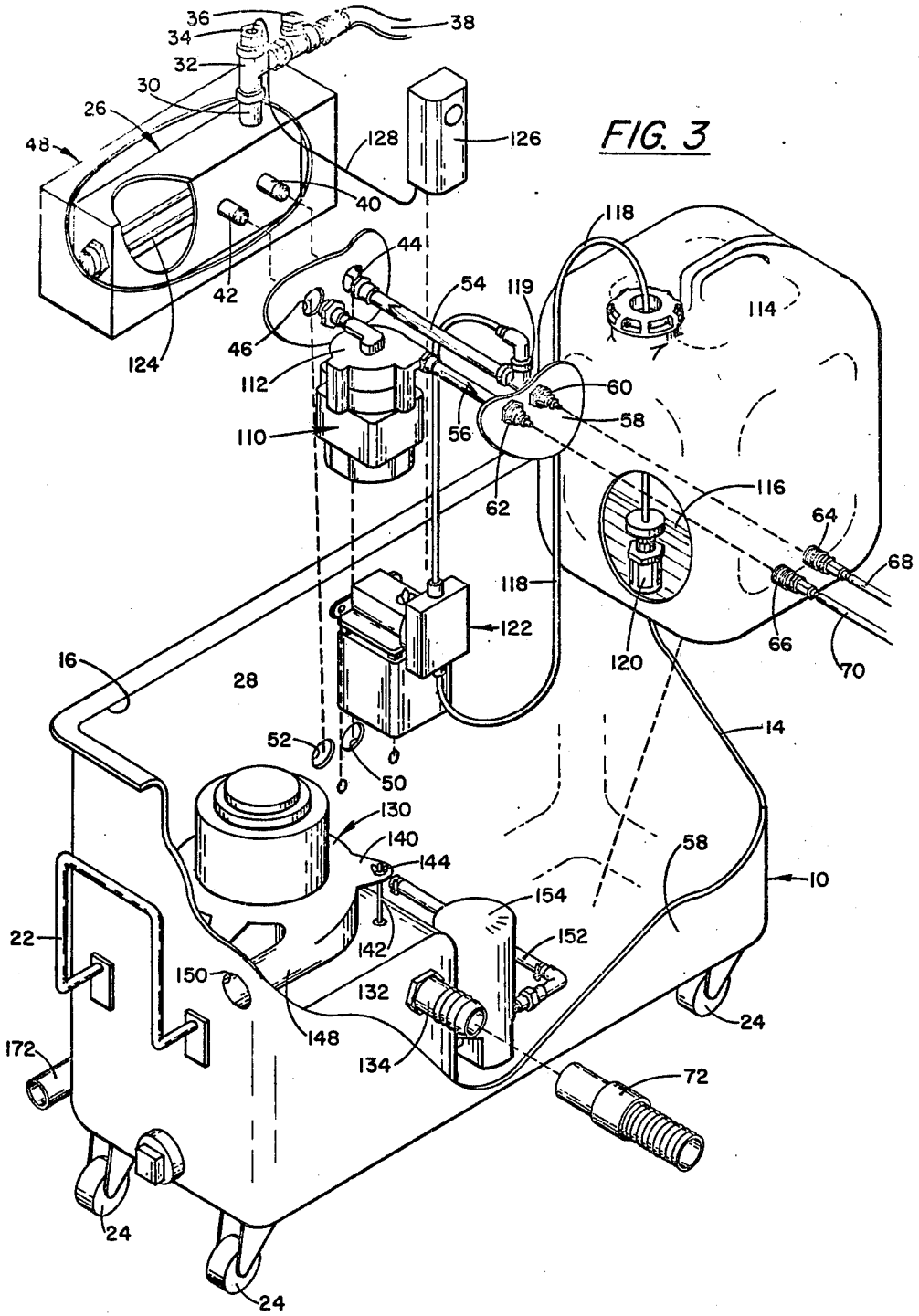
FIG. 3 is an exploded perspective view, partially broken away for illustrative purposes, of the generating unit of FIG. 1.

Calling attention now to FIG. 3, it will be noted that a reservoir section 26 is mounted on the back side 28 of housing 14 in any convenient manner. An upwardly projecting nipple 30 is welded, threaded or otherwise affixed to reservoir 26 to form an inlet port thereinto.

Connected to inlet port 30 is a pipe "T" 32 having a packing nut or gland 34 disposed in and closing its upper opening. In the third opening of the "T" 32 there is secured a one way check valve 36, which is releasably coupled to one end of a flexible hose or conduit 38. The other end of hose 38 should be releasably attached to any conveniently located faucet or similar valve (not shown) which is connected into a continuous source of water under pressure, such as a municipal water supply.

As will be readily understood by those in the art, the inlet port 30, pipe "T" 32, check valve 36 and hose 38 form a feed passage for the movement of water from the faucet or remote water source (not shown) into the reservoir 26. The check valve 36, of course, is arranged so that water will move through this feed passage in only one direction (into the reservoir 26) thereby preventing any reverse movement from the reservoir 26 back into the feed passage.

It should also be pointed out that while the water source preferably should provide cold water to the device, hot water may be used should a cold water source not be readily available.

Two spaced apart nipples 40 and 42 project transversely from the reservoir 26 into the housing 14 through apertures 44 and 46 in reservoir cover 48, and openings 50 and 52 in the back side 28 of the housing. Mounted on the nipples 40 and 42 internally of housing 14, are a pair of manifold members 54 and 56, both of which project through front side 58 of housing 14.

Manifolds 54 and 56 and nipples 40 and 42 are, of course, hollow and thus communicate freely not only with the interior of reservoir 26 but with each other through the reservoir 26. In this embodiment, as will be apparent from the following description, manifold 54 and nipple 40 comprise an inlet into reservoir 26, and manifold 56 and nipple 42 an outlet therefrom.

Outwardly of housing front wall 58, the manifold members are provided with seat portions 60 and 62 which are adapted to releasably receive sockets 64 and 66 as provided at one end of flexible conduits or pressure hoses 68 and 70. Preferably, seat portions 60 and 62 and sockets 64 and 66 cooperatively form "quick release" couplings such as those commonly used in connection with compressed air systems. Thus, pressure hoses 68 and 70 may be released easily and quickly from manifolds 54 and 56 for purposes of transporting or storing the cleaning device.

As best seen from FIG. 1, pressure hoses 68 and 70 extend outwardly from housing 14 to approximately the mid-point of a relatively large diameter suction hose or conduit 72, the purpose of which will be explained herebelow. Actually, the hoses 68 and 70 do not terminate at that point, but rather enter the suction hose 72 via elbows 74 and 76. From that point, the pressure hoses 68 and 70 continue outwardly through the suction hose 72. For convenience of manufacture and assembly, the suction hose 72 includes a connective nipple 78 and couplers 80 and 82 at the point of entry of hoses 68 and 70.

From this point of entry, the suction hose 72 and pressure hoses 68 and 70 conjointly continue outwardly for engagement with the generally cylindrical handle portion 84 of cleaning head 12. This handle portion 84 is relatively short, and terminates in an angularly disposed, outwardly flared nozzle portion 86.

Referring now to FIG. 2, it will be noted that internally, the nozzle portion 86 defines two chambers—a suction chamber 88 which communicates with the suction hose 72 through hollow handle portion 84, and a dispensing chamber 90 which is isolated from both the suction chamber 88 and the hollow handle portion 84. As will be noted, chambers 88 and 90 open outwardly on a common plane whereby both chambers will be operative simultaneously when the cleaning head 12 is placed against carpeting, upholstery or some other surface to be cleaned.

A manually operable control assembly or control means is carried by cleaning head 12. This assembly includes a body section 92 disposed within handle portion 84. The outer ends of pressure hoses 68 and 70 are coupled to body section 92, and internally body section 92 defines a connecting passage 94 which communicates with the interior of both pressure hoses. The pressure hoses thus communicate with one another through the connecting passage 94. Accordingly, an endless or circuitous flow path or system is provided through reservoir section 26, manifolds 54 and 56, pressure hoses 68 and 70 and connecting passage 94. The purposes of this circuitous system will be described in further detail hereinafter.

Referring back to the manually operable control assembly provided by cleaning head 12, the body section 92 includes a feed channel 96 which communicates at one end with the connecting passage 94 and at the other end with tube 98 which in turn communicates with a spray head 100 through a valve section 102. As the structural details of the valve 102 are not a part of this invention, they are not illustrated in detail. As will be readily apparent to those in the art, however, the valve section 102 is intended to normally close feed channel 96 to prevent any egress of fluid from the above described circuitous system. Upward manual movement of valve trigger 104 will, of course, open channel 96 for the selective release of fluid, the quantity or volume of released fluid being controlled by the degree of movement of the trigger 104.

The spray head 100 is mounted in dispensing chamber 90 and includes a short bore 106 which in effect forms a continuation of channel 96. The bore 106 is positioned so that a stream of fluid ejected therefrom will strike an angled face 108 which atomizes the stream into a fan shaped spray or jet which is discharged downwardly over substantially the full width of dispensing chamber 90.

Operatively interposed in one of the manifold members is a pump assembly 110 having an impeller section 112 which, in effect, forms a part of the manifold. This pump assembly may be placed in either manifold, and arranged to circulate fluid in either direction through the circuitous system. In the instant embodiment, however, the pump assembly 110 is interposed in manifold 56, with the impeller section 112 positioned to force fluid outwardly from reservoir 26 through manifold 56, hose 70 and into connecting passage 94. From connecting passage 94, the fluid is then returned to the reservoir 26 through hose 68 and manifold 54. Thus, in the illustrated embodiment, manifold 54 comprises an inlet into and manifold 56 an outlet from the reservoir 26.

As will be clearly understood from the above description, the circuitous system is filled with an aqueous liquid or water which is fed from a remote source through hose 38, check valve 36, pipe "T" 32 and inlet port 30 into reservoir 26, from where it is circulated through the system. Since the remote water source will be under pressure on the order of that normally present in a municipal water or well supply (i.e. 30 to 80 P.S.I.) the circuitous system of this invention will fill and remain full of liquid under pressure so long as it is connected to the remote liquid source.

Disposed within housing 12 is a container 114 for holding a supply of a concentrated cleaning compound 116 preferably of a biodegradable type to comply with present ecological requirements. For convenient reference, this cleaning compound generally will be referred to hereinafter as a "detergent". The capacity of container 114 may be varied according to the time over which continuous operation of the generating unit 10 may be desired. Should very extended periods of operation be anticipated, in fact, the container 114 could take the form of a large drum or similar container disposed externally of housing 12.

Means is provided for injecting a metered quantity of detergent 116 into the manifold member 54 for diffusion into the liquid therein to generate or form a cleaning solution.

For this purpose there is provided a tube or conduit 118 extending between the detergent 116 in container 114 and a second intake port 119 in manifold 54. Preferably this tube 118 is provided with a filter 120 at its inner end and formed from a resilient plastic to permit convenient withdrawal from the container 114 for changing or refilling the container.

Interposed intermediate the ends of tube 118 is a pump assembly 122 which is bolted or otherwise attached to the back side 28 of housing 12. This pump should be capable of generating greater hydraulic or hydrostatic force than the pressure of the liquid in manifold 54. Obviously, unless pump 122 is capable of generating force greater than that of the liquid, little or no detergent could be injected into the circuitous system. In this connection, the pump 122 utilized in the preferred embodiment is of a positive displacement diaphragm type capable of delivering manually variable output quantities at pressures of up to 100 P.S.I. This pressure range is higher than the water pressure found in the usual municipal or private water source, whereby the preferred embodiment will operate satisfactorily under any anticipated operating conditions. Such a pump is available as Model 22SPB from the Calgon Corporation, Milwaukee, Wis. 53209.

Since the generating unit 10 might be left attached to the pressurized water source during periods when the cleaning device is not in use and pump 128 not running, water might have a tendency to flow from manifold 54 through tube 118 and into the detergent container 114 unless restrained against such movement. Thus, if pump unit 122 does not include an internal check valve, a separate check valve preferably should be interposed in tube 118 in such manner as to permit fluid movement therethrough in only one direction—from the container 114 into manifold 54.

In this connection, it should be pointed out that check valve 36 in the water feed passage will prevent loss of detergent from container 114 as might occur should the generating unit 12 be left turned on but not in use for a lengthy period of time. The greater pressure generated by the pump (100 P.S.I.) compared to the usual water pressure (25–80 P.S.I.) could result in emptying of the detergent container 114 into the water source in the absence of check valve 36.

As water and detergent simultaneously enter the circuitous system through their respective feed passages either initially or to replenish the cleaning solution released through the cleaning head 12, they are automatically mixed or diffused together to form cleaning solution as they circulate through the system. Thus, regardless of the amount of solution released from the system for cleaning purposes, the system is continuously replenished.

To insure maximum cleaning efficiency of the solution, preferably it is kept heated to a constant preselected temperature of about 180° F. as it circulates through the system. For this purpose, an electrically operated immersion type heating element 124 is disposed in reservoir 26 in contact with the solution circulating therethrough. Control of the element 124 is provided by a manually variable thermostat 126 mounted in housing 14. A thermocouple 128 extends from the thermostat 126 through packing nut or gland 34 and into the reservoir 26 to operate the thermostat 126 and hence the heating element 124. Accordingly, the cleaning solution is maintained at the preselected temperature as it circulates to and through the cleaning head 12 whereby heated solution is immediately available at all times for immediate application to a surface to be cleaned. It will be understood, of course, that while a temperature of about 180° F. has been found to provide the best overall cleaning action, other lower or higher temperatures may be selected to meet the requirements of a particular material being cleaned.

In prior art cleaning devices, a heated supply of cleaning solution is shown as being provided in the generating unit, but there is no provision for circulating the heated solution to the cleaning head. Thus, the solution left in the head and connective hose of such prior devices will rapidly cool between periods of use, necessitating that the head and hose be drained or purged of cold or "stale" solution after every period of non-use through a working day. The waste, inconvenience and lost time involved in such draining or purging are completely eliminated by the present invention.

In cleaning carpeting, upholstery, and other similar surfaces normally present in automobiles, buses, trucks, etc., cleaning solution sprayed onto a surface from dispensing chamber 90 is removed from the surface along with all entrained soil and debris. Such removal is accomplished by generating a relatively strong suction in the suction chamber 88 in cleaning head 12. Thus, as the head 12 is placed into contact with and moved over a surface to be cleaned while valve 102 is open, cleaning solution in the form of an atomized steam or jet is first sprayed onto the surface through dispensing chamber 90 and subsequently picked up along with entrained dirt and debris through suction chamber 88.

The required suction is generated by suction blower 130 which is mounted on the top of a suction or holding tank 132, both the suction blower 130 and tank 132 being disposed in housing 14. Suction tank 132 includes a suction intake 134 spaced substantially above the bottom of the tank and extending through the front side 58 of housing 14 for connection with the inner end of flexible suction conduit or hose 72, the outer end of which is attached to cleaning head 12 for communication with suction chamber 88.

Figure 4:
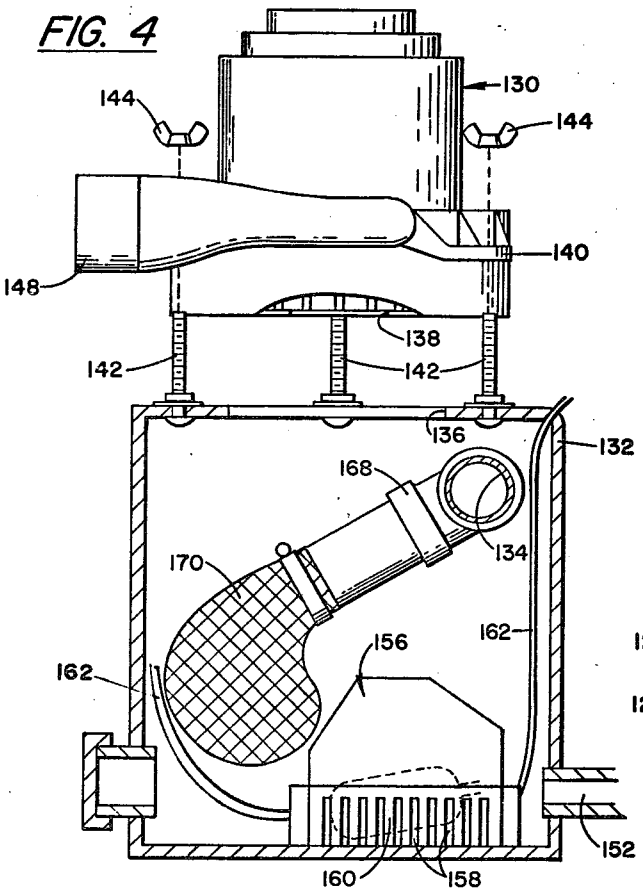
FIG. 4 is a cross sectional view of the suction tank and suction blower assembly of the preferred embodiment as shown in FIG. 1.

As best shown in FIG. 4, suction tank 132 includes a centrally disposed aperture 136 in its top surface, this aperture forming a suction outlet communicating with an intake 138 in the bottom of suction blower 130.

It will be understood that in FIG. 4 the suction blower 130 is shown in an exploded relation with rank 132 for purposes of illustration. As assembled for use, the blower 130 is tightly attached to the top of tank 132 by brackets 140 formed on blower 130 and adapted to receive bolts 142 and wing nuts 144. A generally tangentally disposed discharge 148 is provided by the suction blower casing, this discharge extending through an aperture 150 in the end of housing 14.

Figure 5:
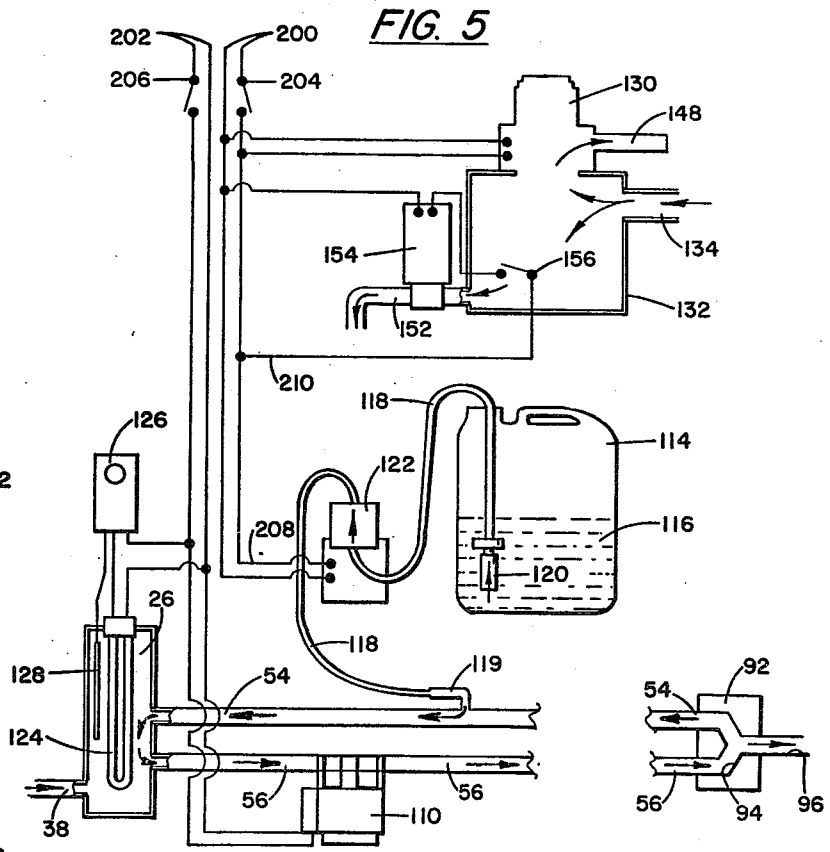
FIG. 5 is a diagrammatic view of the electrical and liquid systems of the embodiment of FIG. 1.

As will be understood from the above discussion, and as diagrammatically illustrated in FIG. 5, operation of the cleaning device will result in spent cleaning solution and entrained soil and debris being pulled into the suction tank 132 along with a quantity of air. The spent solution, soil and debris, of course, will fall to the bottom of tank 132, and the air will be exhausted through the suction blower 130.

In the usual prior art device having a suction pick up, it is necessary to frequently inspect the holding tank to determine when full, and to turn the device off and discontinue its use to permit periodic emptying of the tank. One of the features of the present invention is the provision of structure for automatically evacuating spent solution and dirt from the tank, thereby eliminating any need for frequent inspection of the device and the inconvenience and inefficiencies of having to discontinue its use periodically to permit manual emptying of the tank. For this purpose there is provided a drain conduit 152 (See FIG. 3) which communicates with the interior of tank 132 at a point proximate its bottom surface. Interposed in drain 152 is a pump unit 154 which is mounted in any convenient manner on the bottom of housing 14. The pump impeller should be sufficiently tight to prevent any significant movement of air or liquid in a reverse direction through drain 152 into tank 132 as a result of the operation of suction blower 130.

Operation of drain pump 154 is controlled by a float actuated switch assembly 156 which, as shown in FIG. 4, includes an outer case resting on the bottom of tank 132. Formed in the outer case are a plurality of apertures 158 through which liquid enters the assembly to move a float 160 located therein vertically between an upper predetermined position closing the switch to operate the pump 154 and a lower predetermined position opening the switch and stopping the pump. The switch assembly 156 includes a waterproof electrical conduit 162 having one end sealed in the switch assembly 156 and the other end passing through the top wall of tank 132 through a tight fitting seal (not shown).

Both the suction blower 130 and drain pump 154 are protected against clogging or inadvertent damage from large pieces of debris. This protection is provided by a relatively coarse mesh bag 170 which is supported in the tank by elbow 168 attached to the suction intake 134. In this connection, the user of the device should occasionally detach the suction blower 130 from tank 132 and remove from bag 170 any large pieces of debris trapped therein.

Drain conduit 152 preferably extends through back side 28 of housing 14 and includes a hose connection (not shown) to which one end of a garden hose 172, or the like, may be attached. The other end of the hose 172 is disposed in any conveniently adjacent drain.

Referring particularly to FIG. 5, the electrical circuitry employed in the present invention includes two circuits 200 and 202 which are adapted to be used with commonly available 120 v A.C. household or commercial power sources. Circuit 200 operates the suction blower 130 and detergent pump 122, and the other circuit 202 operates the circulating pump 110 and the heating element 124. Switches 204 and 206 are suitably connected in the positive side of circuits 200 and 202, respectively, for purposes of selectively actuating the components of the generating unit.

The negative side of line 200 by-passes switch 204 and runs directly to detergent pump 122 and drain pump 154. The positive side is connected through switch assembly 204 with detergent pump 122 by cable 208, and with the float actuated switch 156 by cable 210. This latter switch, of course, controls the operation of drain pump 154 depending upon the quantity of spent detergent in tank 132.

In the second circuit 202, the negative side is connected directly to circulating pump 110 and to the heating element 124. The positive side is connected through switch 206 with circulating pump 110, and through the thermostat 126 with the heating element 124.

OPERATION OF PREFERRED EMBODIMENT

As will be understood from the above description, the present cleaning device is readied for use merely by (1) attaching the water line or hose 38 to a source of water and to the check valve 36, (2) attaching the drain hose 172 to the drain discharge 152, (3) plugging the electrical circuits into an appropriate electrical receptacle, and (4) filling the container 114 with a detergent.

Thereafter, the switches 204 and 206 are closed, which starts the suction blower 130, detergent pump 122, circulating pump 110 and heating element 124. As these various devices are operating, water and detergent are fed into the circuitous system described heretofore, and are both mixed and heated therein as they circulate through the system. After the circulating solution has reached the desired temperature (about 180° F. in most instances), the cleaning head 12 may then be placed against a soiled surface and the valve 102 opened an appropriate amount as the head is moved back and forth over the surface to be cleaned. A jet of hot cleaning solution will then be discharged onto the surface from spray head 100 in discharge chamber 90 to loosen and suspend soil on the surface, whereafter the suction in suction chamber 88 will draw the spent solution and entrained soil and debris from the surface into the tank 132. Any large pieces of debris will be retained by the bag 170 in tank 132, with the balance of the intake being dissipated through the suction blower 130 or falling into the bottom of the tank 132. When the amount of spent solution reaches a predetermined height within the tank 132, the float actuated switch 156 will actuate discharge pump 154 to evacuate the spent solution through drain discharge 152 and the attached drain hose.

During operation of the device, it may be necessary to adjust the quantity of detergent metered into the manifold 54. If a particularly dirty surface is to be cleaned, the ratio of detergent may be increased in the cleaning solution by adjusting the flow rate of detergent pump 122. Or alternately should too much detergent be present, as evidenced by an excessive amount of foam in tank 132, the pump 122 may be adjusted to reduce the amount of detergent. Also, fluctuations in the water pressure may require adjustment of the quantity of detergent.

While the foregoing description and appended drawings are directed particularly to the preferred embodiment of the present invention, it will be understood that various changes and modifications may be made without departing from the scope of the invention as set forth in the appended claims. For instance, the cleaning device is not limited to one detergent source but may include two or more reservoirs which could be used alternately under different conditions. Also for certain work and using certain detergents, the cleaning solution may preferably be maintained as some temperature other than about 180° F.

Having thus described the invention, what is claimed as new and desired to protect by Letters Patent is:

1. A cleaning device having a generating unit and a remote cleaning head, characterized by a reservoir section carried by said generating unit, a body section carried by said cleaning head and provided with a connecting passage, means defining a first passage communicating at one end with said reservoir section and at its other end with said connecting passage, means defining a second passage communicating at one end with said reservoir and at its other end with said connecting passage, said first and second passages communicating with one another through said reservoir section and said connecting passage and providing therewith a closed circuitous system extending through and between said generating unit and said body section, a first port opening into said system, means defining a first feed passage for unidirectionally feeding a continuing supply of aqueous liquid under pressure from a remote liquid source through said first port into said system, a second port opening into said system, means defining a second feed passage for unidirectionally feeding a continuing but selectively variable supply of detergent under pressure from a detergent source through said second port into said system for diffusion in the liquid therein to form a continuing supply of cleaning solution, pressure being transmitted through said ports and maintaining said cleaning solution under continuous pressure throughout said system, means for circulating said pressurized cleaning solution through said system, means in said reservoir for heating said circulating solution to a pre-determined temperature, control means carried by said body portion for releasing a manually variable quantity of heated cleaning solution from said connecting passage into said cleaning head for application to a surface to be cleaned, means for removing spent cleaning solution and entrained soil from said surface through said cleaning head and into said generating unit, and means for evacuating said spent solution and entrained soil from said generating unit for disposal through a remote disposal source.

2. A cleaning device according to claim 1, characterized by said first passage means comprising a first manifold connected to and defining an inlet into said reservoir section and a first flexible conduit communicating with said first manifold and said connecting passage, and said second passage means comprising a second manifold connected to and defining an outlet from said reservoir section and a second flexible conduit communicating with said second manifold and said connecting passage.

3. A cleaning device according to claim 2, characterized by said circulating means comprising a first pump unit operatively interposed in one of said manifolds for impelling said cleaning solution through said one manifold and hence through said system, said first port opening into said reservoir section, and said second port opening into said other manifold.

4. A cleaning device according to claim 3, characterized by said detergent source comprising a refillable container carried in said generating unit, said second feed passage comprising a tubular conduit extending from within said container into communicaition with said second port, means comprising a second pump unit operatively interposed in said tubular conduit for impelling said detergent therethrough, and means for manually varying the quantity of detergent impelled through said tubular conduit whereby the strength of the cleaning solution is selectively variable.

5. A cleaning device according to claim 1, characterized by said control means comprising a spray section disposed within a dispensing chamber defined by said cleaning head, means defining a channel communicating with said connecting passage and said spray section, and valve means operatively interposed in said channel, said valve means normally being biased to close said channel but being manually operable to open said channel to permit the movement of cleaning solution therethrough from said system to said spray section for atomization in said dispensing chamber.

* * * * *